United States Patent [19]

Rose et al.

[11] 4,088,098

[45] May 9, 1978

[54] CROSS-SCAVENGED, TWO-CYCLE INTERNAL COMBUSTION ENGINE

[75] Inventors: Edgar Rose, Glencoe; Richard A. Wlezien, Antioch, both of Ill.

[73] Assignee: Outboard Marine Corporation, Waukegan, Ill.

[21] Appl. No.: 675,531

[22] Filed: Apr. 9, 1976

[51] Int. Cl.[2] ..... F02F 3/24

[52] U.S. Cl. ..... 123/73 A; 123/65 PD

[58] Field of Search ..... 123/65 PD, 73 PP, 73 A, 123/65 VB; 92/141

[56] References Cited

U.S. PATENT DOCUMENTS

| | | | |
|---|---|---|---|
| 929,622 | 7/1909 | Neuber | 123/73 A |
| 1,046,359 | 12/1912 | Winton et al. | 123/73 A |
| 1,122,965 | 12/1914 | Manning | 123/73 A |
| 2,352,267 | 6/1944 | Kelsey | 123/65 VB |
| 2,513,563 | 7/1950 | Ikert | 123/73 A |
| 3,601,008 | 8/1971 | Alexander, Jr. | 92/141 |

FOREIGN PATENT DOCUMENTS

| | | | |
|---|---|---|---|
| 72,361 | 9/1916 | Austria | 123/73 PP |
| 19,784 | 10/1913 | United Kingdom | 123/65 PD |
| 170,433 | 10/1921 | United Kingdom | 123/65 VB |

*Primary Examiner*—Irwin C. Cohen

*Attorney, Agent, or Firm*—Michael, Best & Friedrich

[57] ABSTRACT

Disclosed herein is a two-cycle, internal combustion engine including a piston mounted for reciprocative movement inside a cylinder and having a top and an inlet face portion which periodically covers and uncovers an intake port during reciprocative movement of the piston, a circumferentially extending recess in the piston at the juncture between the top and inlet face portion thereof and having an inner wall which extends in front of a limited portion of the intake port located farthest away from the outlet port such that, as the piston inlet face starts to uncover the intake port, an initial flow of fresh charge flows through only the limited portion of the intake port and is deflected by the recess inner wall towards the cylinder head and along the cylinder intake wall in a direction generally parallel to the longitudinal axis of the cylinder, and a deflector carried on the top of the piston and spaced inwardly from the piston recess for deflecting additional streams of fresh charge flowing through the intake port, during subsequent uncovering thereof by the piston inlet face, toward the cylinder head in a direction generally parallel to the cylinder axis but inwardly from the initial stream of fresh charge so that the cylinder is progressively filled with fresh charge from the cylinder inlet wall towards the cylinder outlet wall.

10 Claims, 7 Drawing Figures

CROSS-SCAVENGED, TWO-CYCLE INTERNAL COMBUSTION ENGINE

BACKGROUND OF THE INVENTION

This invention relates to two-cycle, internal combustion engines and more particularly to cross scavenging systems for such engines.

Cross-scavenged, two-cycle internal combustion engines typically include some means, such as a deflector carried on top of the piston, for guiding the flow of incoming fresh charge across the cylinder towards the exhaust ports in a manner to purge the combustion products or exhaust gases from the cylinder. Prior constructions for such means usually are relatively complex and/or are inefficient because the fresh charge becomes partially mixed with the exiting exhaust gases.

SUMMARY OF THE INVENTION

The invention provides a two-cycle, internal combustion engine comprising an engine block, a cylinder in the engine block having a head and generally opposed intake and outlet walls respectively including at least one intake port through which a fresh charge is admitted into the cylinder and at least one outlet port through which exhaust gases are exhausted from the cylinder, a piston mounted for reciprocative movement inside the cylinder and having a top and an inlet face portion which periodically covers and uncovers the intake port during reciprocative movement of the piston, and a circumferentially extending recess in the piston at the juncture between the top and inlet face portion thereof and having an inner wall which extends in front of a limited portion of the intake port located farthest away from the outlet port such that, as the piston inlet face starts to uncover the intake port, an initial flow of fresh charge flows through only said limited portion of the intake port and is deflected by the recess inner wall towards the cylinder head and along said cylinder intake wall in a direction generally parallel to the longitudinal axis of the cylinder. In addition, the engine includes deflector means carried on the top of the piston and spaced inwardly from the piston recess for deflecting additional streams of fresh charge flowing through the intake port, during subsequent uncovering thereof by the piston inlet face, towards the cylinder head in a direction generally parallel to the cylinder axis but inwardly from the initial stream of fresh charge so that the cylinder is progressively filled with fresh charge from the cylinder inlet wall towards the cylinder outlet wall.

In a preferred embodiment, the inner wall of the piston recess is spaced radially inwardly from the cylinder inlet wall in generally parallel spaced relationship.

In another preferred embodiment, the cylinder includes a plurality of circumferentially spaced intake ports, the piston recess extends in front of only one or more of the centrally located intake ports, and the deflector includes a front face which is located on the intake side of the piston, which extends transversely across the piston in front of the intake ports generally parallel to a diametric medial plane between the intake and outlet sides of the piston, and which extends from the top of the piston substantially parallel to the longitudinal axis of the cylinder. To promote progressive and relatively uniform filling of the cylinder with fresh charge, the front face of the deflector preferably includes opposed end portions each including an end part which extends to adjacent the cylinder wall and which is spaced inwardly from respective of the end intake ports at a distance to prevent choking of the incoming fresh charge flowing therethrough and a central portion which is spaced farther away from the medial plane than the end parts of the end portions, which extends in front of the centrally located intake port or ports and which is spaced inwardly from the centrally located intake port or ports at a distance to prevent choking of incoming fresh charge flowing therethrough.

One of the principal features of the invention is the provision of a cross-scavenged, two-cycle internal combustion engine including a baffling arrangement which, although simple in construction, is capable of providing efficient scavenging.

Another of the principal features of the invention is the provision of a cross-scavenged, two-cycle internal combustion engine including a baffling arrangement which times the flow of incoming fresh charge so that the engine cylinder is progressively and uniformly filled with fresh charge from the cylinder intake wall towards the cylinder outlet wall.

Other features and advantages of embodiments of the invention will become apparent upon reviewing the following detailed description, the drawings and the appended claims.

Figure 2:
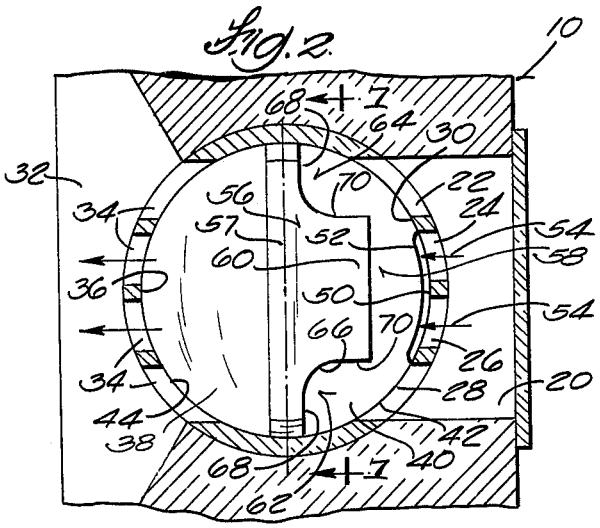
FIG. 2 is a fragmentary, horizontal sectional view taken along the line 2—2 in FIG. 1.

Before explaining at least one embodiment of the invention in detail, it is to be understood that the invention is not limited in its application to the details of the construction and the arrangement of components set forth in the following description or illustrated in the drawing. The invention is capable of other embodiments being practiced and carried out in various ways. Also, it is to be understood that the phraseology and terminology used herein is for the purpose of description and should not be regarded as limiting.

DESCRIPTION OF THE PREFERRED EMBODIMENTS

Illustrated in the drawings is an engine block 10 (shown fragmentarily) for a two-cycle internal combustion engine. The engine block 10 includes one or more cylinders 12, a cylinder head 14 having a threaded aperture 16 for receiving a spark plug 18 (shown fragmentarily) and a suitable transfer passage 20 which is located on one side of the cylinder 12 and is connected in communication with the engine crank case.

A fresh charge of incoming gases, which comprises a mixture of fuel and air when the engine employs a conventional carburetor or air only when direct fuel injection is used, flows from the transfer passage 20 into the cylinder 12 through one or more inlet or intake ports. In the specific construction illustrated, a plurality of circumferentially spaced intake ports 22, 24, 26 and 28 are provided in the intake wall 30 of the cylinder 12 for this purpose. The upper edges of all of the inlet ports 22, 24, 26 and 28 are located at substantially the same height.

The engine block 10 also includes an exhaust manifold 32 which is located on the side of the cylinder 12 opposite the transfer passage 20 and receives the combustion products or exhaust gases from the cylinder 12 through one or more exhaust or outlet ports 34 provided in the outlet wall 36 of the cylinder 12.

Mounted for reciprocative movement inside the cylinder 12 is a piston 38 (shown fragmentarily) which is connected to the engine crankshaft (not shown) by a suitable connecting rod (not shown). The piston 38 includes a working top surface or top 40, an inlet face portion 42 which covers and uncovers the inlet ports 22, 24, 26 and 28 and an outlet face portion 44 which covers and uncovers the outlet ports 34 as the piston 38 reciprocates during engine operation. The intake and outlet ports are positioned at relative heights to be uncovered by the piston 38 at a time most effective for proper scavenging of the exhaust gases from the cylinder 12 as the cylinder is filled with a fresh charge. In the specific construction illustrated, the upper edges of the outlet ports 34 are located closer to the cylinder head 14 than the upper edges of the intake ports 22, 24, 26 and 28, so that the piston 38 uncovers the outlet ports first during the down stroke, thereby releasing the pressure in the cylinder 12 before the inlet ports are uncovered to admit a fresh charge.

Figure 1:
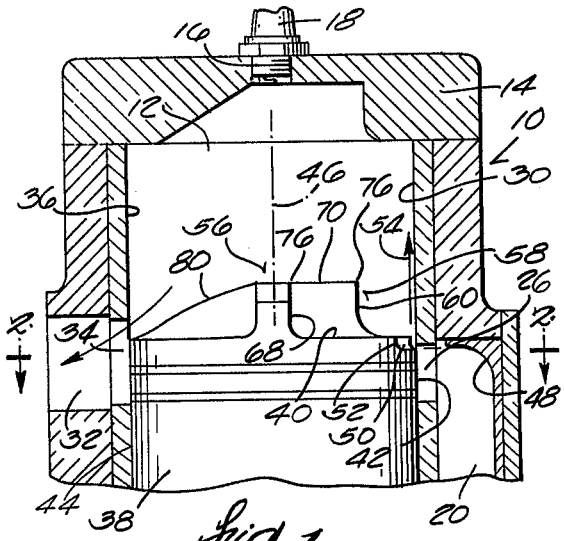
FIG. 1 is a fragmentary, vertical sectional view of a two-cycle internal combustion engine embodying various features of the invention, showing the piston at a position where fresh charge is intially admitted into the cylinder through the intake ports.

The fresh charge preferably enters the cylinder 12 through the intake ports 22, 24, 26 and 28 in a direction generally perpendicular to the longitudinal axis of the cylinder, represented by dashed line 46 in FIG. 1. For this purpose, the upper portion of the transfer passage 20 can be provided with a curved wall surface 48 and/or one or more turning vanes (not shown) which tends to establish the desired flow direction of the fresh charge just before it passes through the intake ports 22, 24, 26 and 28.

The piston 38 includes a baffling arrangement which provides progressive filling of the intake portion of the cylinder with a fresh charge and a relatively uniform flow of the fresh charge across the cylinder toward the exhaust ports 34 so as to effectively purge the exhaust gases from the cylinder 12 with a minimum loss of combustible products. More specifically, the piston 38 is provided with a circumferentially extending recess 50 at the juncture between the top 40 and the inlet face portion 42. The recess 50 includes an inner wall 52 which is spaced radially inwardly a small distance (e.g., 0.060 inch) from the cylinder intake wall 30 in parallel relation thereto and extends in front of a limited portion of the intake ports 22, 24, 26 and 28 farthest away from the outlet ports 34. In the specific construction illustrated, the recess inner wall 52 extends in front of only the two center intake ports 24 and 26.

As the piston inlet face portion 42 starts to uncover the inlet ports during the piston downstroke, the recess 50 permits an initial stream of fresh charge, illustrated by arrows 54, to flow into the cylinder 12 through only the two center intake ports 24 and 26. The initial stream 54 of fresh charge is diverted by the recess inner wall 52 towards the cylinder head 14 and flows along the cylinder intake wall 30 in a direction generally parallel to the longitudinal axis 46 of the cylinder 12.

Carried on the top 40 of the piston 38 for diverting additional portions of the incoming fresh charge towards the cylinder head 14 during subsequent further uncovering of the center inlet ports 24 and 26 and uncovering of the two outer or end intake ports 22 and 28 is a guide or deflector 56. The deflector 56 has a substantially flat front face 58 which extends transversely across the top of the piston 38 on the inlet side thereof. As used herein, the inlet side of the piston 38 refers to that portion located on the right side of a diametric medial plane (represented by dashed line 57 in FIG. 2) extending through the longitudinal axis 46 of the cylinder 12 and the outlet side of the piston 38 refers to that portion located on the left side of the medial plane 57. The deflector front face 58 extends transversely generally parallel to the medial plane 57, extends from the top 40 of the piston 38 substantially parallel to the longitudinal axis 46 of the cylinder 12 and the medial plane 57 and has a height relative to the intake ports 22, 24, 26 and 28 sufficient to prevent the incoming fresh charge from flowing directly across the cylinder 12 from the intake ports toward the outlet ports 34.

In order to provide a more uniform and progressive filling of the intake side of the cylinder 12 with fresh charge, the deflector front face 58 preferably includes a central portion 60 which extends transversely in front of the center inlet ports 24 and 26 and opposite end portions 62 and 64.

Figure 4:
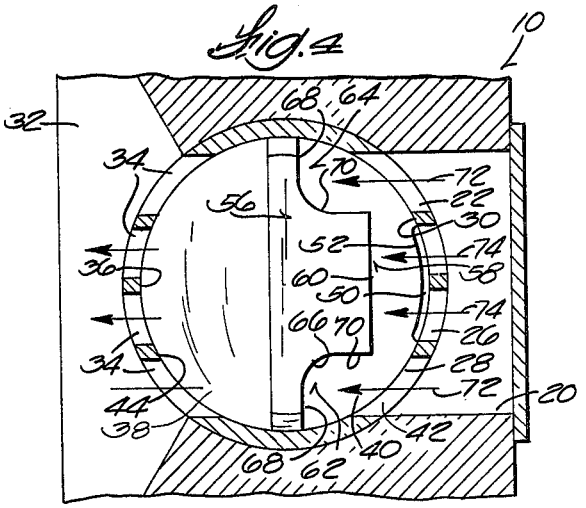
FIG. 4 is a horizontal sectional view taken along the line 4—4 in FIG. 3.
Figure 3:
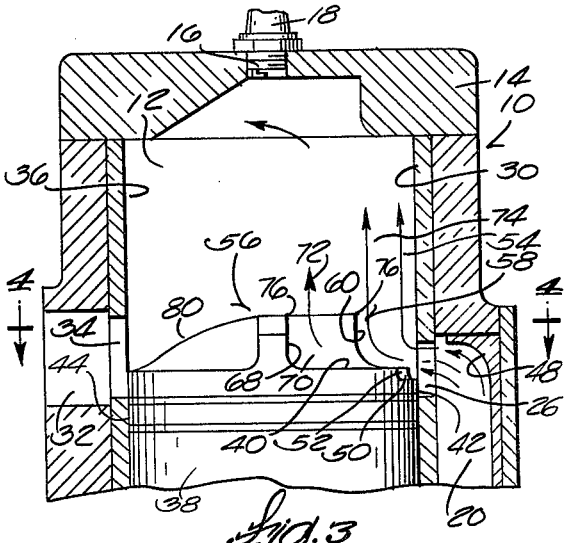
FIG. 3 is a view similar to FIG. 1 showing the piston in an intermediate position relative to the intake ports.

Each of the end portions 62 and 64 have a concave central part 66 extending between two end parts 68 and 70. The end parts 68 and 70 extend at right angles relative to each other with one end part 70 forming a right angle corner with the central portion 60 of the deflector front face 58 and the other end part 68 extending adjacent the cylinder wall. The end parts 68 of the end portions 62 and 64 are spaced inwardly from the respective portions of the cylinder intake wall 30 in which end intake ports 22 and 28 are located at a distance where the fresh charge flowing through the end intake ports, represented by arrows 72, can be diverted thereby toward the cylinder head 14 in a direction generally parallel to the longitudinal axis 46 of the cylinder 12 without choking the end intake ports 22 and 28 (FIGS. 3 and 4). The outer corner of each end part 68 can be chamfered to afford some peripheral cross flow.

The central portion 60 of the deflector front face 58 is spaced farther away from the medial plane 57 than the end parts 68 and is spaced inwardly from the portion of the cylinder intake wall 30 in which the two center intake ports 24 and 26 are located at a distance where additional fresh charge flowing through the center intake ports 24 and 26 (after initial uncovering by the piston recess 50) can be diverted thereby toward the cylinder head 14 in a direction generally parallel to the longitudinal axis 46 of the cylinder without choking the intake ports 24 and 26 (FIG. 3). This additional flow of fresh charge is represented by arrows 74.

The central portion 60 and the end portions 62 and 64 of the deflector front face 58 preferably terminate in a sharp, right angle corner 76 so that the incoming gases separate from the deflector 56 at that point and maintain the flow direction initiated by the deflector front face 58. The base portions of the deflector front face 58, including the base portions of the central portion 60 and the base portions of the central part 66 and the end parts 68 and 70 of the end portions 62 and 64, preferably are curved to facilitate the desired upward turning of the gases.

As best shown in FIG. 3, the flow paths of the additional incoming fresh charge 72 and 74 flowing through the intake ports, during further uncovering of the two center intake ports 24 and 26 and initial uncovering of the intake ports 22 and 28, generally are inwardly from the flow path of the initial stream of fresh charge 54 admitted by the piston recess 50.

Figure 5:
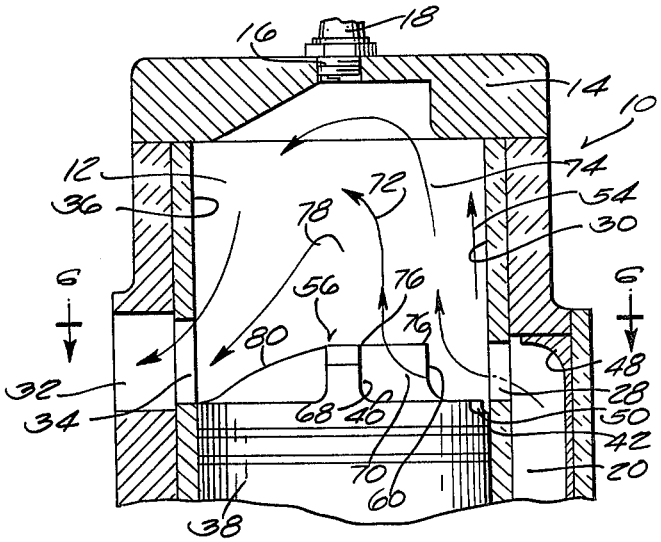
FIG. 5 is a view similar to FIG. 1 showing the piston at the bottom of its stroke relative to the intake and outlet ports.

As all of the intake ports 22, 24, 26 and 28 are completely uncovered, the flow of incoming fresh charge increases and a portion thereof, represented by arrow 78, is deflected by the deflector front face 58 more towards the center of the cylinder head 14 as shown in FIG. 5.

Figure 6:
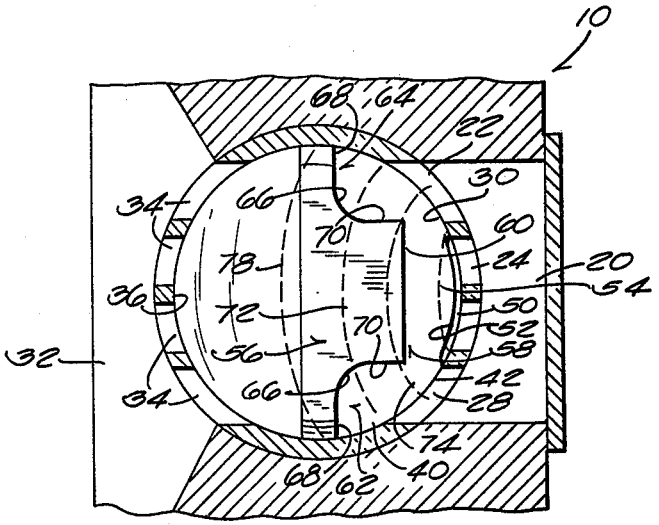
FIG. 6 is a fragmentary, horizontal view taken along lines 6—6 in FIG. 5 including a diagrammatic representation of the flow pattern of the incoming fresh charge as the cylinder is filled therewith.
Figure 7:
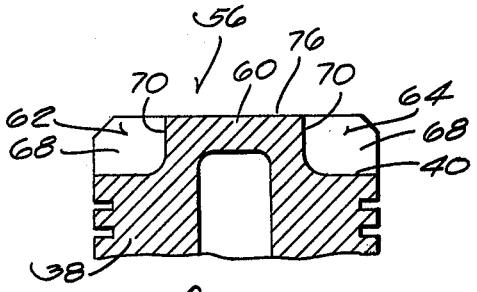
FIG. 7 is a sectional view taken along line 7—7 in FIG. 1.

With this baffling arrangement, the center intake ports 24 and 26 and the end intake ports 22 and 28 are opened sequentially and the incoming fresh charge is diverted toward the cylinder head 14 by the deflector front face 58 in a manner such that the intake side of the cylinder 12 is progressively filled from the cylinder intake wall 30 with the incoming fresh charge which flows toward the cylinder head 14, across the cylinder 12 and then downwardly towards the outlet ports 34 to push the exhaust products from the cylinder through the outlet ports 34. The progressive filling of the cylinder 12 with the fresh charge is illustrated diagrammatically in FIG. 6 wherein the dotted lines represent a top view of the various flow streams illustrated in FIGS. 1–5. This progressive filling of the intake side of the cylinder 12 effectively provides a reasonably well defined interface between the incoming fresh charge and the exiting exhaust gases and a relatively uniform displacement of the exhaust gases across the cylinder 12, thereby minimizing mixing of the fresh charge and the exhaust gases.

To facilitate the uniform expulsion of the exhaust gases from the cylinder 12, the deflector 56 preferably is provided with exhaust ramp 80 on the exhaust or outlet side of the piston 34. The exhaust ramp 80 assists in guiding the exhaust gases toward the exhaust ports 34.

Various features of the invention are set forth in the following claims.

What is claimed is:

1. A two-cycle, internal combustion engine comprising an engine block, a cylinder in said engine block having a head and generally opposed inlet and outlet walls respectively including at least one intake port through which a fresh charge is admitted into said cylinder and at least one outlet port through which exhaust gases are exhausted from said cylinder, a piston mounted for reciprocative movement inside said cylinder, said piston having a top surface extending transversely to the axis of said cylinder and an inlet face portion which periodically covers and uncovers said intake port during reciprocative movement of said piston, a circumferentially extending recess in said piston at the juncture between said top surface and said inlet face portion, said recess having an inner wall which extends downwardly from said top surface in radially inward relation from said inlet face portion, said inner wall being in front of a limited portion of said intake port and located in closely adjacent proximity thereto such that, as said piston inlet face starts to uncover said intake port, an initial flow of fresh charge flows through only said limited portion of said intake port and is deflected by said recess inner wall towards said cylinder head and along said cylinder intake wall in a direction generally parallel to the longitudinal axis of said cylinder, and deflector means on said piston top surface and including a front face extending upwardly from said top surface in radially inwardly spaced relation from said inner wall and directly behind same at a greater distance from said inlet face portion than said inner wall, said deflector means deflecting additional streams of fresh charge flowing through the entire intake port, during subsequent uncovering thereof by said piston inlet face, towards said cylinder head inwardly from the initial stream of fresh charge so that said cylinder is progressively filled with fresh charge from said cylinder inlet wall towards said cylinder outlet wall.

2. A two-cycle, internal combustion engine according to claim 1 wherein said recess inner wall is spaced radially inwardly from said cylinder inlet wall in generally parallel spaced relationship.

3. A two-cycle, internal combustion engine according to claim 1 wherein said cylinder inlet wall includes a plurality of said intake ports located in circumferentially spaced relationship and said piston recess extends in front only of one or more of the centrally located of said intake ports.

4. A two-cycle, internal combustion engine according to claim 1 wherein said piston includes an intake side and an outlet side and said front face is located on said piston intake side, extends transversely across said piston in front of said intake port, and extends from said piston top surface substantially parallel to said cylinder axis.

5. A two-cycle, internal combustion engine according to claim 4 wherein said front face includes opposed end portions each including an end part which extends transversely generally parallel to a diametric medial plane between said piston intake and outlet sides and a central portion which extends transversely generally parallel to a diametric medial plane between said piston intake and outlet sides, which is spaced farther from the medial plane than said end parts, and which extends in front of only said limited portion of said intake port.

6. A two-cycle, internal combustion engine according to claim 5 wherein each of said end portions have a concave central part extending between two end parts which extend at right angles relative to each other, one of said end parts forming a right angle corner with said central portion and the other of said end parts extending to adjacent the cylinder wall.

7. A two-cycle, internal combustion engine according to claim 6 wherein said front face terminates in a sharp corner.

8. A two-cycle, internal combustion engine according to claim 3 wherein said piston includes an intake side and an outlet side, and said front face is located on said piston intake side, extends transversely across said piston in front of said intake ports, and extends from said piston top surface substantially parallel to said cylinder axis, said front face including opposed end portions each including an end part which extends to adjacent the cylinder wall and which is spaced inwardly from respective end ones of said intake ports at a distance to prevent choking of the incoming fresh charge flowing therethrough and a central portion which extends generally parallel to a diametric medial plane between said piston intake and outlet sides, which is spaced farther from the medial plane than said end parts of said end portions, which extends in front of said centrally located intake port, and which is spaced inwardly from said centrally located port at a distance to prevent choking of incoming fresh charge flowing therethrough.

9. A two-cycle, internal combustion engine according to claim 8 wherein each of said end portions have a central part extending between two end parts, one of said end parts forming a right angle corner with said central portion and the other of said end ports extending to adjacent the cylinder wall.

10. A two-cycle, internal combustion engine according to claim 9 where said central portion and said end portions terminate in a right angle corner.

* * * * *